US009668620B2

(12) United States Patent
Ishikawa et al.

(10) Patent No.: US 9,668,620 B2
(45) Date of Patent: Jun. 6, 2017

(54) TOILET PAPER PRODUCTION METHOD AND TOILET PAPER

(75) Inventors: Shigeo Ishikawa, Shizuoka (JP); Akira Hirasawa, Shizuoka (JP)

(73) Assignee: DAIO PAPER CORPORATION, Ehime (JP)

( * ) Notice: Subject to any disclaimer, the term of this patent is extended or adjusted under 35 U.S.C. 154(b) by 439 days.

(21) Appl. No.: 14/002,065

(22) PCT Filed: Feb. 14, 2012

(86) PCT No.: PCT/JP2012/053334
§ 371 (c)(1),
(2), (4) Date: Aug. 28, 2013

(87) PCT Pub. No.: WO2012/117842
PCT Pub. Date: Sep. 7, 2012

(65) Prior Publication Data

US 2013/0337243 A1 Dec. 19, 2013

(30) Foreign Application Priority Data

Feb. 28, 2011 (JP) ..... 2011-041981

(51) Int. Cl.
*A47K 10/16* (2006.01)
*D21H 27/00* (2006.01)

(52) U.S. Cl.
CPC ..... *A47K 10/16* (2013.01); *D21H 27/002* (2013.01); *Y10T 428/24934* (2015.01)

(58) Field of Classification Search
CPC ..... Y10T 428/24934; D21H 27/002; A47K 10/16
See application file for complete search history.

(56) References Cited

U.S. PATENT DOCUMENTS

2004/0071758 A1* 4/2004 von Heimburg ..... A61K 8/0208 424/443
2007/0071797 A1* 3/2007 Hernandez-Munoa . A61L 15/34 424/443

FOREIGN PATENT DOCUMENTS

| | | |
|---|---|---|
| JP | S 6133628 | 2/1986 |
| JP | H049121 | 1/1992 |
| JP | 2007015379 | 1/2007 |
| JP | 2008208492 | 9/2008 |
| JP | 2009178572 | 8/2009 |
| JP | 2009183411 | 8/2009 |
| JP | 2009240721 | 10/2009 |

(Continued)

*Primary Examiner* — Xiao Zhao
(74) *Attorney, Agent, or Firm* — Muncy, Geissler, Olds & Lowe, P.C.

(57) ABSTRACT

To solve problems such as tearing in using or manufacturing sanitary thin paper for household use that is embossed and applied with aqueous chemicals. The problem is solved by a method for manufacturing toilet paper, comprising: a chemicals applying step of printing and applying aqueous lotion chemicals onto band-like continuous crepe paper by a printer, while a pattern with a non-chemicals-application portions and chemicals-application portions is formed; and an embossing step where the embossing convex portions are brought into press-contact only to the non-chemicals-application portions of the continuous crepe paper so that the continuous crepe paper is embossed.

10 Claims, 7 Drawing Sheets

(56) References Cited

FOREIGN PATENT DOCUMENTS

| | | | |
|---|---|---|---|
| WO | WO2005/106119 | A1 | 11/2005 |
| WO | WO2007/031965 | A2 | 3/2007 |

* cited by examiner

TOILET PAPER PRODUCTION METHOD AND TOILET PAPER

TECHNICAL FIELD

The present invention relates to a method for manufacturing toilet paper and to toilet paper.

BACKGROUND ART

There is a type of toilet paper, which is embossed as well as impregnated with water-based lotion chemicals (hereinafter, also referred to as aqueous lotion chemicals).

The toilet paper of this type is embossed so as to have uneven surfaces, which improve the characteristics such as a wiping property and bulkiness property (thickness hand feel and bulkiness), and is impregnated with aqueous lotion chemicals, which improve the characteristics such as a moisture-retaining property (wetness hand feel), flexibility (softness hand feel), and a surface lubricating property (smoothness hand feel).

By the way, it is said that ⅓ of Japanese population suffers from a hemorrhoid disease, and for a person with the disease, it is difficult to rub his or her skin strongly with toilet paper in cleaning operation after excretion. For this reason, such a patient with the hemorrhoid disease is highly interested in toilet paper, which is improved in a wiping property, bulkiness, a moisture-retaining property, softness, and a surface lubrication property, so that he or she desires products satisfying these properties. As for his or her cleaning manner, in many cases, a disease area is cleaned by pressing or press-contacting with the toilet paper so as not to stimulate the disease area.

Meanwhile, there are some consumers, even if who do not suffer from hemorrhoid disease, requesting high-quality toilet papers, and particularly such consumers tend to put a high value on the above-described functions.

In these days, shower toilets become widely used, and after using such a shower toilet, the cleaning operation is performed by press-contacting rather than rubbing with toilet paper. In this case, the toilet paper needs to have high water absorption ability and to effectively conduct the cleaning operation by the above mentioned pressing manner, while it is in a water-absorbing state.

However, conventional toilet paper, which is embossed and is impregnated with aqueous lotion chemicals, has the following disadvantages related to functional advancement and the above wiping manner.

Conventionally, toilet paper, which is embossed and impregnated with chemicals, is produced in a manner such that one entire surface of single base paper or that of multi-ply continuous crepe paper is applied with the chemicals and is embossed by an embossing roll.

Here, by using aqueous lotion chemicals, which are likely to permeate into the paper in the thickness direction, hydrogen bonding between fibers therein is reduced and strength is degraded, since the toilet paper does not generally include a wet paper strength agent in consideration of a water disintegration property or the like.

In order to improve the above mentioned wiping property, the bulkiness, the moisture-retaining property, the softness, and the surface lubricating property, amount of applied aqueous lotion chemicals is increased or depth of each embossed concave portion is enlarged. However, by doing so, paper breakage is caused in the embossing due to the above degraded strength, and hence it is difficult to attain the functional advancement. In the embossing, since a convex portion provided in an embossing roll needs to be pressed against the base paper, a side wall of each embossed concave portion, which is extended from a bottom to a non-embossed portion without pressing by the convex portion, is elongated. Accordingly, as for change in a density state of fibers in the embossed concave portions, at this time, density of the fibers tends to be reduced. Further, in the above mentioned conventional method for manufacturing the toilet paper, since the chemicals are impregnated also into the side wall during the embossing. As a result, tensile strength of the side wall becomes low so that the paper breakage is caused at the side wall during the embossing.

Further, in addition to the above problem in the conventional method for manufacturing the toilet paper, there is a problem also in conventional products. Precisely, since the tensile strength becomes low at the side wall, in case of the above mentioned cleaning manner by pressing with the toilet paper for e.g., the patient with the hemorrhoid disease or the user after the shower toilet, the cleaning operation is performed in a direction along which the side wall is torn, resulting in high frequency of an accident of tearing at the side wall.

Furthermore, a toilet roll applied with oil-based lotion chemicals is also available in the market, but it is used only for a so-called pit toilet in which it is not assumed that used toilet paper is flushed down thereto. This means that there has been no toilet roll, which is applied with the oil-based lotion chemicals and which has a water disintegration property so as to be adapted to a water-saving toilet widely used within our country. Further, there have been no products applied with the oil-based lotion chemicals accepted by consumers, due to stickiness hand feel of the oil-based lotion chemicals.

CITATION LIST

Patent Literature

Patent Literature 1: Japanese Patent Application Laid-Open No. 2009-183411

Patent Literature 2: Japanese Patent Application Laid-Open No. 2009-178572

Patent Literature 3: Japanese Patent Application Laid-Open No. 2009-240721

SUMMARY OF INVENTION

Technical Problem

Therefore, it is a main object of the present invention to solve a problem such as tearing of embossed toilet paper impregnated with aqueous chemicals in the using and in the manufacturing.

Solution to Problem

The present invention that solves the above mentioned problem and the advantageous effects of the present invention are stated below.

<Invention of Claim 1>

A method for manufacturing toilet paper impregnated with aqueous lotion chemicals, comprising:

a chemicals applying step of printing and applying aqueous lotion chemicals onto band-like continuous crepe paper by a printer using a printing plate cylinder and an impression cylinder, while a pattern with non-chemicals-application portions and chemicals-application portions is formed on the band-like continuous crepe paper; and an embossing step of passing the continuous crepe paper, which has been applied with the chemicals in the chemicals applying step, between an embossing roll with embossing convex portions and a backing roll making a pair with the embossing roll, while the embossing convex portions are brought into press-contact only to the non-chemicals-application portions of the continuous crepe paper so that the continuous crepe paper is embossed.

<Invention of Claim 2>

The method for manufacturing the toilet paper according to claim 1, wherein the impression cylinder doubles as the backing roll so that the chemicals applying and the embossing can be performed by the only one impression cylinder.

<Invention of Claim 3>

The method for manufacturing the toilet paper according to claim 1 or 2, wherein after the chemicals applying step, chemicals-application positions of the continuous crepe paper are checked by a chemicals-application position detecting device and emboss positions are adjusted in response to the checking result.

<Invention of Claim 4>

The method for manufacturing the toilet paper according to any one of claims 1 to 3, wherein the chemicals-application portions are arranged in a regular pattern of a net shape or a lattice shape in a plan view.

<Invention of Claim 5>

The method for manufacturing the toilet paper according to any one of claims 1 to 4, wherein the total area of the chemicals-application portions is set to 30 to 70% of a total area of one side surface of a paper plane.

<Invention of Claim 6>

The method for manufacturing the toilet paper according to any one of claims 1 to 5, wherein in the embossing roll, the embossing convex portions are arranged with a gap therebetween, the density of the embossing convex portions is 2.0 to 32.0 units/$cm^2$, and the area of one embossing convex portion in a plan view is 0.64 to 4.0 $mm^2$.

<Invention of Claim 7>

The method for manufacturing the toilet paper according to any one of claims 1 to 6, wherein the embossing convex portion has a shape of chamfered tetragon in a plan view.

<Invention Of Claim 8>

The method for manufacturing the toilet paper according to any one of claims 1 to 7, wherein the height of the embossing convex portion is 1.1 to 1.5 mm.

<Invention of Claim 9>

The method for manufacturing the toilet paper according to any one of claims 1 to 8, wherein a convex embossing roll is used of which the embossing convex portions are regularly arranged in horizontal and vertical directions.

<Invention of Claim 10>

The method for manufacturing the toilet paper according to any one of claims 1 to 9, wherein the embossing convex portions are brought into press-contact to only one side surface of the continuous crepe paper so as to provide only concave embossed portions on the one side surface of the toilet paper and only convex embossed portions corresponding to the concave embossed portions on the other side surface of the toilet paper.

<Invention of Claim 11>

Toilet paper that is manufactured by the method for manufacturing the toilet paper according to any one of claims 1 to 10.

Advantageous Effects of Invention

According to the above stated present invention, it is possible to solve a problem such as tearing of embossed toilet paper impregnated with aqueous chemicals in the using and in the manufacturing.

DESCRIPTION OF EMBODIMENTS

Figure 1:
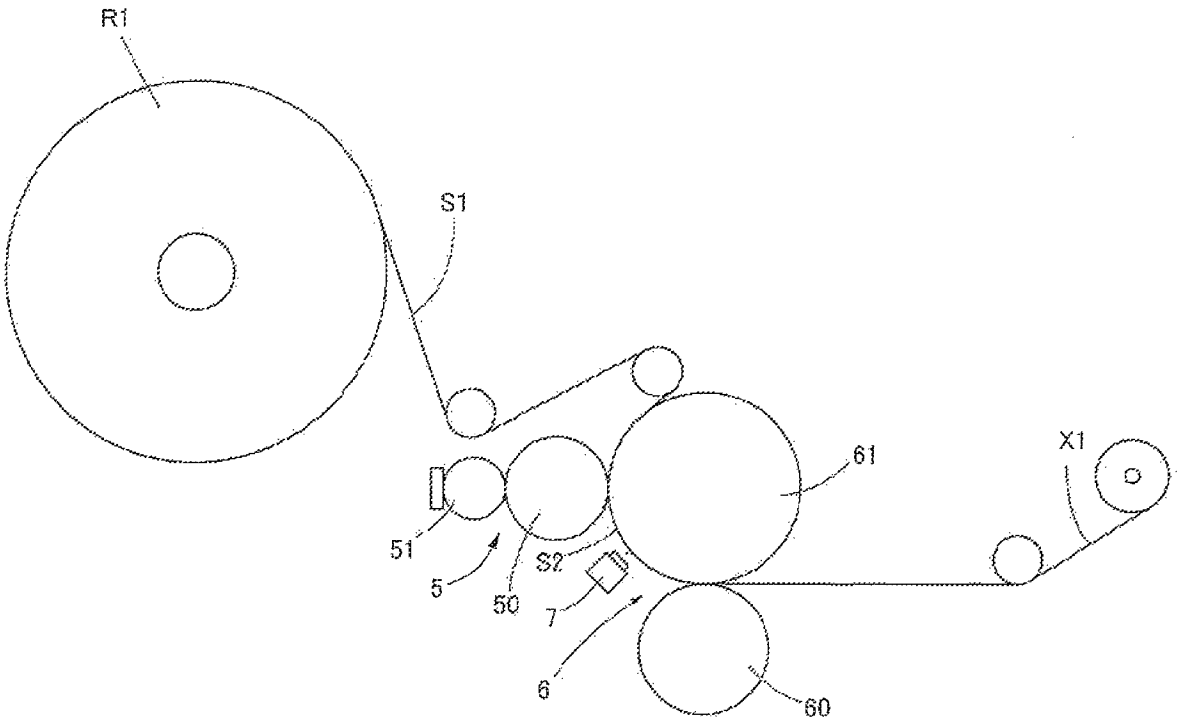
FIG. 1 is a diagram illustrating a method for manufacturing toilet paper of the present invention.

Next, an embodiment of the invention will be described in detail hereinafter, with reference to FIGS. 1 to 7.

[Outline of Example of a Method for Manufacturing Sanitary Thin Paper for Household Use]

An outline of a method for manufacturing toilet paper X1 embossed and impregnated with aqueous lotion chemicals according to the present invention will be explained.

First, band-like continuous crepe paper S1 with an appropriate ply structure is reeled out of a paper roll R1 and is supplied to a printer 5 so that a printer 5 prints by applying the aqueous lotion chemicals onto band-like continuous crepe paper, forming a pattern with non-chemicals-application portions and chemicals-application portions thereon. Alternatively, continuous crepe paper can be reeled out of non-ply paper rolls so as to be plied at a previous stage of the printer 5.

The printer 5 can print one side surface or also both side surfaces. However, it is preferable to print one side surface, because in such case, pattern application can be attained with high accuracy without necessity of adjustment of print portions between both the side surfaces. Further, it is preferable to use, as the printer 5, a flexographic press or gravure printer, both of which can easily perform a pattern application. It is particularly preferable to use the flexographic press, because a printing plate cylinder 50 is flexible, a print pattern is accurate, and an amount of the applied chemicals can be easily adjusted. In the example illustrated in the drawings, a flexographic press with a doctor chamber 51 is used.

Subsequently, continuous crepe paper S2, which has been applied with the chemicals, is continuously supplied to an embossing device 6, while embossing convex portions are brought into press-contact only to the non-chemicals-application portions of the continuous crepe paper so as to emboss the paper. In the embossing, a known steel-rubber embossing device 6 can be used, which is composed of a metal convex embossing roll 60 provided with the many embossing convex portions on a peripheral surface thereof and a rubber backing roll 61 contacted to the convex embossing roll 60 at a peripheral surface thereof.

Rotation of the respective rolls and cylinders and conveyance of the continuous crepe paper S1, S2 are adjusted so that the print pattern, which is formed by the convex printing plate cylinder 50 or concave printing plate cylinder 50 used in the printer 5, can be corresponding to an emboss pattern, which is formed by plural embossing convex portions of the convex embossing roll 60, so as to manufacture the toilet paper X1, which has been thus embossed and impregnated with the aqueous lotion chemicals according to the present invention.

Figure 7:
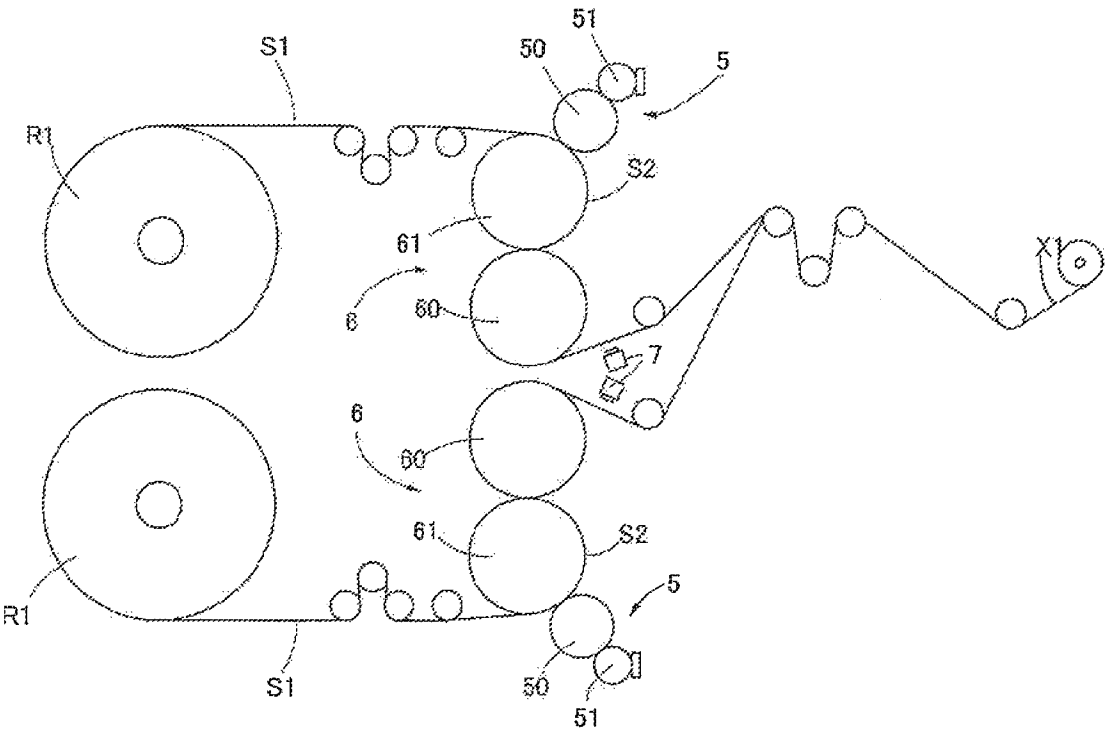
FIG. 7 is a diagram illustrating further another method for manufacturing toilet paper of the present invention.

In a regular pattern of the present invention, emboss positions 10, 10, . . . are provided to be subsequent to chemicals-application portions 2, 2, . . . , by embossing the crepe paper so as not to emboss at the chemicals-application portions 2, 2, . . . . Then, it is preferable to set a positional relation of the chemicals-application portions 2, 2, . . . and the emboss positions 10, 10, . . . accurately as much as possible in the regular pattern. Accordingly, positional deviation of the continuous crepe paper S1, S2 caused by elongating or shortening thereof and the like should be minimized. Thus, as illustrated in FIGS. 1 and 7, an impression cylinder 61, which makes a pair with the printing plate cylinder 50, doubles as the rubber backing roll 61 so that the chemicals applying and the embossing can be performed continuously with the only one impression cylinder 61. Particularly, it is desirable to perform the embossing immediately after the chemicals applying.

Further, the chemicals-application positions are checked by a known application position detecting device 7 using infrared and visible light reflection during conveyance of the continuous crepe paper S2, which has been applied with the chemicals, so that the emboss positions can be adjusted in response to the checking result. Alternatively, after the continuous crepe paper is embossed, the chemicals-application positions can be checked by the application position detecting device 7.

Figure 2:
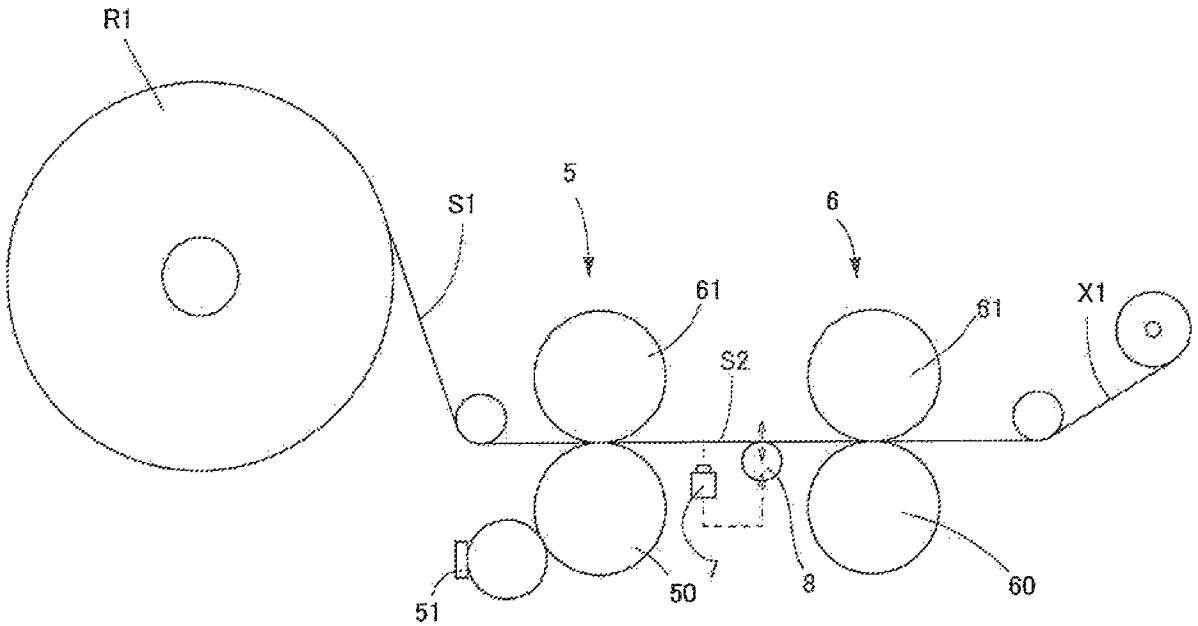
FIG. 2 is a diagram illustrating another method for manufacturing toilet paper of the present invention.
Figure 3:
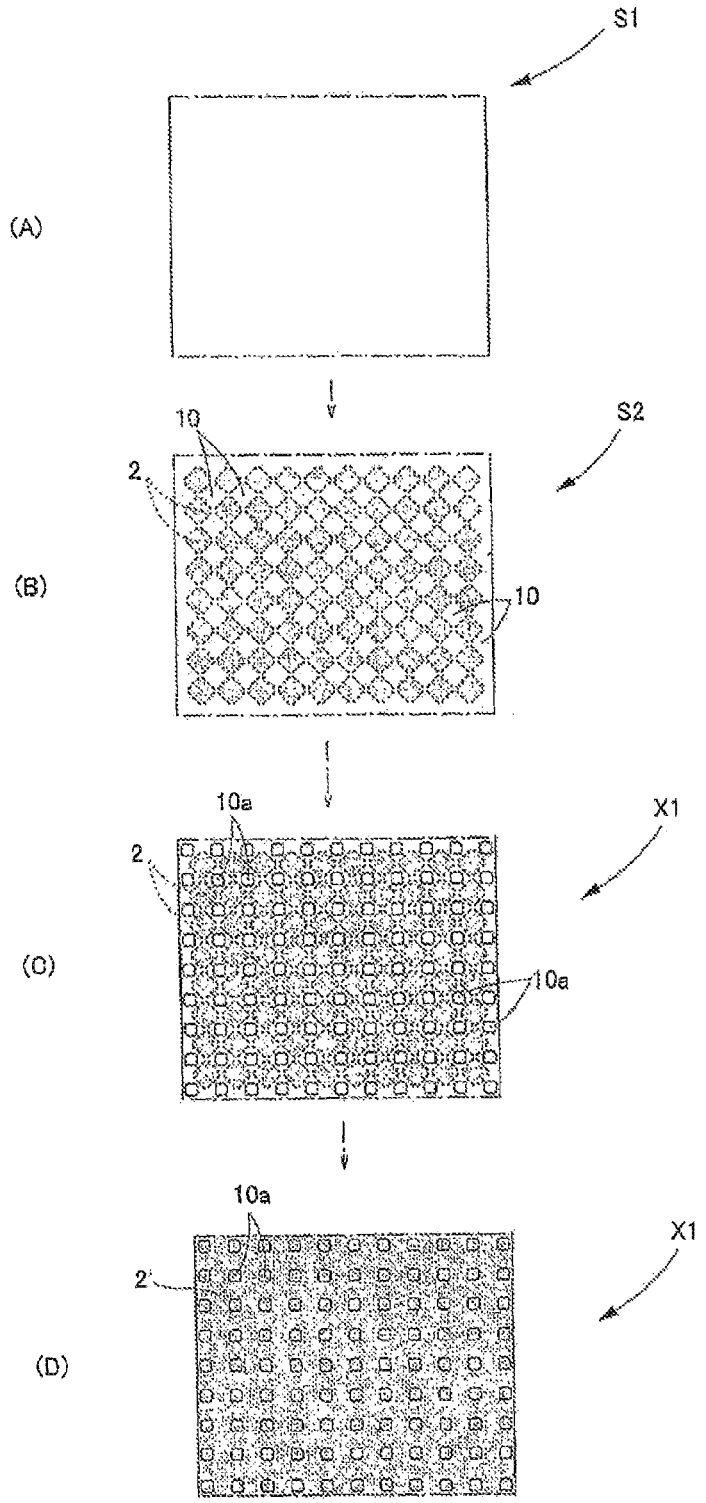
FIG. 3 is a plan view illustrating respective steps for manufacturing toilet paper of the present invention.

Such a positional adjustment can be performed by, for example, controlling of rotation speed of the printing plate cylinder 50 with a servomotor when the chemicals applying and the embossing are performed by the one impression cylinder 61 as in the examples of FIGS. 1 and 7. Alternatively, as illustrated in FIG. 2, when the chemicals applying and the embossing are performed with an impression cylinder 61 of a printer 5 and with a rubber backing roll 61 of an embossing device 6, respectively, while chemicals-application positions 2, 2, . . . and emboss positions 10, 10, . . . can be adjusted by a positional adjustment with a tension roll 8, which is interposed between the printer 5 and the embossing device 6.

As stated above, in the present invention, immediately after applying the aqueous lotion chemicals to the continuous crepe paper S1, the embossing is performed by bringing the embossing convex portions into press-contact to a portion other than the chemicals-application portions. Accordingly, since strength of each emboss position is not lowered because of no application of the chemicals, tearing is not occurred in the embossing. Additionally, embossing pressure can be increased more ever than before, resulting in the reliable emboss. Furthermore, the aqueous lotion chemicals are, after applied, diffused with time in a plane direction of the continuous crepe paper S1. Since it takes a relatively long time for the aqueous lotion chemicals to diffuse, compression of fibers at a ridge of each concave embossed portion formed on the toilet paper and that at a corner of a bottom of each embossed portion formed on the toilet paper is not crushed beyond necessity. Accordingly, even by the diffusion of the aqueous lotion chemicals, a shape of each emboss is not lost but can be kept.

Furthermore, the crepe paper S1 can include a sizing agent in order to ensure sufficient time until the embossing is started after the chemicals applying. When the crepe paper includes the sizing agent, it takes longer time to permeate and diffuse the chemicals. For this reason, it is possible to sufficiently ensure the time until the embossing is started after the chemicals applying. Accordingly, it is possible to reliably employ a case in which the chemicals are not impregnated at the emboss positions in the embossing.

Here, as described above, it takes a relatively long time to diffuse the aqueous lotion chemicals with time in continuous crepe paper S1 in the plane direction thereof. FIGS. 3(A) to 3(D) illustrate a procedure of manufacturing the toilet paper from the continuous crepe paper. FIG. 3(D) illustrates the toilet paper after a predetermined time elapses, and a chemicals impregnation portion is denoted by the reference numeral 2'. Here, in FIG. 3(D), the chemicals are diffused in the entire surface of the toilet paper in the plan view, but in the present invention, another case may be exemplified in which the chemicals are not diffused to reach the emboss portions. Further another case may be exemplified in which amounts of impregnated chemicals are different between the emboss portions and the rest.

In a normal manufacturing line for sanitary thin paper products, the embossing is performed before the chemicals are diffused. Specifically indicating a preferable time until the embossing is started after the chemicals applying, it is sufficient to take 0.3 seconds or less. Further, it requires about 8 hours to diffuse sufficiently the aqueous lotion chemicals in the toilet paper X1 with time in the plane direction. The about 8 hours are reserved normally for manufacturing the toilet paper X1 by the applying, the embossing until completion (packing) of the products.

The embossing is ensured by base paper-strength of the crepe paper as well as the diffusion of the aqueous lotion chemicals with time in the plane direction of the crepe paper, which improves, in the toilet paper X1 according to the present invention, the wiping property and the bulkiness property brought by the embossing and the moisture-retaining property, the flexibility, and the surface lubricating property brought by the aqueous lotion chemicals. Further, a water disintegration property is ensured by using the aqueous lotion chemicals, which is easily dissolved into water. From the viewpoint of the water disintegration property, it is desirable that the toilet paper X1 according to the present invention does not include a wet paper strength agent. That is, it is desirable not to include a step for adding the wet paper strength agent in manufacturing the toilet paper.

It should be noted that the embossing recited in the present invention is performed in order to improve the bulkiness property and the wiping property, and is different from so-called ply bonding, which would be performed merely in order to bond plies one another.

In the toilet paper X1, which is embossed and impregnated with the chemicals by the method for producing thereof according to the present invention, the chemicals are not required necessarily to impregnate into the entire surface of the toilet paper, in the wiping manner performed by the press-contacting rather than the rubbing with the toilet paper, that is, in the manner for the patient with the hemorrhoid disease or the user after the shower toilet, as described in the section of Background Art. Accordingly, in the toilet paper which is manufactured by the present invention, there may be a case where the concave embossed portion, particularly, the bottom of the same may not be impregnated with the chemicals, and there also may be another case where there is difference of the amount of the impregnated chemicals between the emboss portion and the rest. Furthermore, it is possible to check existence of the partial impregnation of the chemicals and that of such difference of the amount of impregnated chemicals by measuring concentration distribution of the chemicals on the paper plane according to near-infrared spectroscopy or the like.

However, it is desirable to be impregnated with the aqueous lotion chemicals to at least 95% or more of the entire surface of the toilet paper in the plan view. Of course, the toilet paper manufactured by the present invention may be impregnated with the chemicals in the entire surface so that there is no any non-chemicals-application portion in the plan view.

As for the ply structure, a two-ply or more ply structure (multi-ply forming structure) is desirable from the viewpoint of the water absorbability or the like.

Hereinafter, the property and composition of the crepe paper, ply structure, embossing manner, type of chemicals, and chemicals applying manner, which are more desirable in the toilet paper impregnated with the chemicals according to the present invention will be described in more detail.

[Crepe Paper]

Meanwhile, a known raw material pulp can be used for the (continuous) crepe paper S1 according to the present invention. For example, wood pulp, recycled pulp, and the like may be exemplified.

In particular, the preferred raw material pulp is a combination of NBKP (Nadelholz Bleached Kraft Pulp) and LBKP (Laubhoulz Bleached Kraft Pulp). Although, recycled pulp may be added, a mixture of only NBKP and LBKP of virgin pulp is more preferable in terms of the favorable hand feel and the like. In this case, the mixture ratio is NBKP: LBKP=10:90 to 50:50, in particular desirably NBKP: LBKP=40:60.

A paper raw material such as raw material pulp becomes a crepe paper through, for example, a known paper manufacturing process, via a wire part, a press part, a dryer part, a size press, a calender part, and the like. In the paper manufacturing, appropriate chemicals e.g., a dispersing agent, a pH adjuster such as caustic soda, an antifoaming agent, an antiseptic agent, and a slime control agent may be added.

As for paper quality of the crepe paper S1, which is not applied yet with the aqueous lotion chemicals, the basis weight measured by JIS P 8124 is preferably 12.0 to 30.0 g/m$^2$ in one-ply in that the aqueous lotion chemicals are diffused with time at an appropriate speed so that after the embossing, it is not crushed with time by the impregnated aqueous lotion chemicals, and an embossed shape is reliably maintained in a state of products. The basis weight of less than 12.0 g/m$^2$ eliminates the thickness hand feel and causes paper breakage after the chemicals applying and the embossing. On the other hand, the basis weight of more than 30.0 g/m$^2$ degrades the availability, due to the roughness or the decreased water disintegration property. Further, such basis weight may require too large amount of chemicals to be used or cause insufficient amount of impregnated chemicals.

Paper thickness (per one ply) of the continuous crepe paper S1 is preferably 100 to 330 μm in two sheets according to measurement by a dial thickness gauge (Peacock thickness gage). The paper thickness of smaller than 100 μm eliminates the thickness hand feel in the state of the products, makes the paper to be likely to stretch, and makes it difficult to locate emboss positions accurately on the non-chemicals-application positions due to too high speed at which the chemicals are impregnated. On the other hand, the paper thickness of larger than 330 μm makes the paper to be rough and may cause insufficient, amount of impregnated chemicals. Particularly, this problem becomes severe in a case of the ply structure.

Tensile strength measured according to JIS P 8113 is measured in the state of the products. That is, one-ply products are measured in the state of the one-ply, while two-ply products are measured in the state of the two-ply. For example, in a case of the two-ply products, it is preferable that the tensile strength (in the length direction) is 320 to 500 cN/25 mm while the tensile strength (in the width direction) is 140 to 250 cN/25 mm. The tensile strengths of the continuous crepe paper, which do not reach the tensile strength in the length direction or width direction, are not preferable, because the production of the toilet paper is reduced due to paper breakage in the manufacturing, the products are likely to be torn or to loose unevenness brought by the emboss in the using. The tensile strengths of the continuous crepe paper, which exceed the tensile strength in the length direction or width direction, are not preferable, because by using such paper, the hand feel is degraded after the aqueous lotion chemicals applying.

[Sizing Agent]

As described before, in the present invention, the crepe paper including the sizing agent is preferably used. The sizing agent can use a known agent and is not particularly limited. For example, a sizing agent such as a rosin sizing agent, a styrene-based sizing agent, alkenyl succinic acid anhydride, alkyl-ketene dimmer, which are effective in a neutral range, may be exemplified.

The sizing agent may be added into the paper raw material of the crepe paper at a paper manufacturing step, and may be added to the crepe paper after the paper manufacturing step. An amount of added sizing agent is preferably 0.5 to 3.0 kg/t with respect to the paper making raw material.

The sizing agent has an effect to appropriately suppress the permeation of the chemicals inside paper layers and has an effect as a lubricating agent by itself as to improve hand feel of a surface of the crepe.

[Number of Plies]

The number of plies of the band-like continuous crepe paper S1 is not particularly limited. However, too multiple plies decreases performance of the embossing and impregnation property of the chemicals and hence, 2 or 3 plies are desirable. Further, the extremely multiple plies degrade the water disintegration property when such a property is required in the paper. From also this point of view, 2 or 3 plies are desirable. Here, the ply in the invention indicates the stacking of papers. Accordingly, 2 or 3 plies indicate a state where 2 or 3 sheets are stacked. However, one ply indicates a state where the number of plies is one.

[Chemicals-Applying]

The total amount of the applied aqueous lotion chemicals on both the side surfaces is 1.0 to 6.5 g/m$^2$, desirably 2.0 to 5.0 g/m$^2$, and more desirably 2.5 to 4.5 g/m$^2$ in both side surfaces regardless of the number of plies. The amount of more than 6.5 g/m$^2$ may cause paper breakage due to decreased paper strength or stretching and too stick paper in quality. Meanwhile the amount of less than 1.0 g/m$^2$ makes it difficult to feel any difference in smoothness hand feel or wetness hand-feel in quality from those of non-applied products. More desirably, when the amount is set to 2.5 to 4.5 g/m$^2$, organoleptic evaluation in the thickness hand feel and the wetness hand feel becomes extremely excellent. Further, particularly in a case of 2 or 3 plies, the effect brought by the impregnated chemicals is sufficiently and reliably exhibited.

The chemicals-application portions 2, 2 are preferably arranged regularly so as to be scattered on the entire paper plane in the length and width directions. In the present invention, since the non-chemicals-application portions are embossed, effect brought by the embossing is exhibited in the entire paper plane. Furthermore, when the chemicals-application portions 2, 2 are arranged in a lattice shape (examples illustrated in FIGS. 3(B), 3(C), and 4) or a net shape in the plan view, it is possible to increase the areas of the chemicals-application portions 2, 2 and to ensure many embossing positions 10, 10 in a wide range.

Meanwhile, the ratio of the chemicals-application portions 2, 2 with respect to entire one side surface of the paper plane is set to 30 to 70%. The ratio of smaller than 30% makes it difficult to exhibit sufficiently the wetness hand feel, the softness hand feel, and the surface lubricating property. This ratio of the chemicals-application portions with respect to entire one side surface of the paper plane is the ratio of the total area of the chemicals-application portions with respect to entire one side surface of the paper plane in a plan view. Accordingly, when the chemicals-application portions 2, 2 are scattered as in the example illustrated in the drawings, the above ratio indicates the ratio of the total area of the chemicals-application portions with respect thereto. Then, the chemicals-application portions arranged in the scattered state with such a ratio ensures the embossing positions 10, 10, so that the effect brought by the embossing can be exhibited sufficiently and besides that, makes it possible to impregnate the chemicals into thus embossed toilet paper, resulting in the further improved function thereof.

The pattern of the applied chemicals can be adjusted depending on the pattern of the printing plate cylinder, and the amount of the applied chemicals can be adjusted by line account of the anilox roll and the like.

(Chemicals)

Meanwhile, the aqueous lotion chemicals according to the present invention include water and polyol. The aqueous lotion chemicals make it possible to exhibit more clearly advantageous effects of the present invention such as eliminating paper breakage and the like. In particular, the aqueous lotion chemicals including glycerin of 70 to 90% as the polyol are desirable. The aqueous lotion chemicals including moisture of 1 to 15% and functional chemicals of 0.01 to 22% are more desirable, and the aqueous lotion chemicals including moisture of 5 to 10% are further more desirable. The moisture in the chemicals may be measured by Karl-Fischer method. Further, the viscosity of the chemicals in the applying is preferably 50 to 300 mPa·s. The chemicals viscosity of smaller than 50 mPa·s causes too rapid permeation of the lotion chemicals between minute fibers in the sheet, so that a desired embossing shape may be easily lost. On the other hand, the chemicals viscosity of more than 300 mPa·s is not preferable, because it is difficult for the lotion chemicals having such viscosity to permeate between the minute fibers in the sheet so that the evenness and hand feel of the surface may be lost.

As the functional chemicals, there are a surfactant, inorganic and organic fine powders, an oily component, and the like. The surfactant is effective to further soften tissue or smoothen the surface thereof, and anionic surfactants, cationic surfactants and amphoteric surfactants are employed. The inorganic and the organic fine powders make the surface to be smooth. The oily component can improve the lubrication property, and higher alcohols such as; liquid paraffin, cetanol, stearyl alcohol, and oleyl alcohol can be employed.

Further, as the functional chemicals, a moisturizing agent may be any combination of one or more of a hydrophilic high molecular gelatinizing agent, collagen, hydrolyzed collagen, hydrolyzed keratin, hydrolyzed silk, hyaluronic acid or salt thereof, ceramide, and the like may be added as the chemicals which maintain the moisture-retaining property of the glycerin.

Further, as the functional chemicals, perfume, emollient agents such as various natural essences and the like, vitamins, an emulsifying agent, which stabilizes mixed components, an antifoaming agent, which stabilizes the chemicals applying by suppressing foaming of the chemicals, an antimold agent, and a deodorant agent such as an organic acid may be appropriately blended. Further, an antioxidant agent of vitamin C and vitamin E may be contained. The components contained in the chemicals are easily dissolved in water or are modified to easily dissolve into water so as to be mixed.

[Embossing]

In the present invention, when the continuous crepe paper S2 is pressed by the embossing convex portions 1, 1, . . . , which are formed on the peripheral surface of the convex embossing roll 60, the aqueous lotion chemicals are not applied to the portions (the embossing positions 10 and 10), which are pressed by the embossing convex portions 1, 1, . . . . For this reason, the paper strength is not lowered at the portions, which are pressed by the embossing convex portions, because the chemicals are not applied there.

Figure 4:
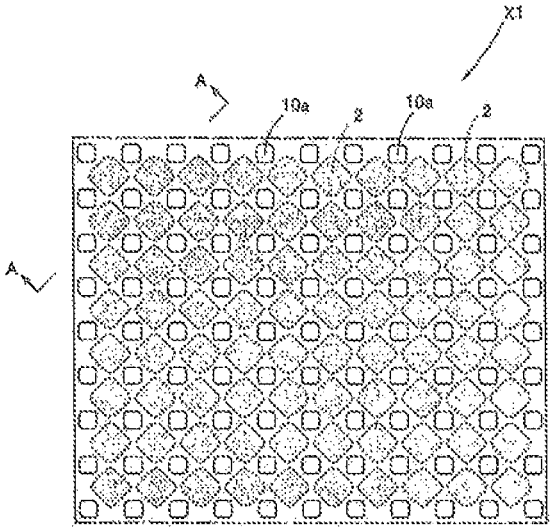
FIG. 4 is a plan view illustrating toilet paper of the present invention immediately after embossing.
Figure 5:
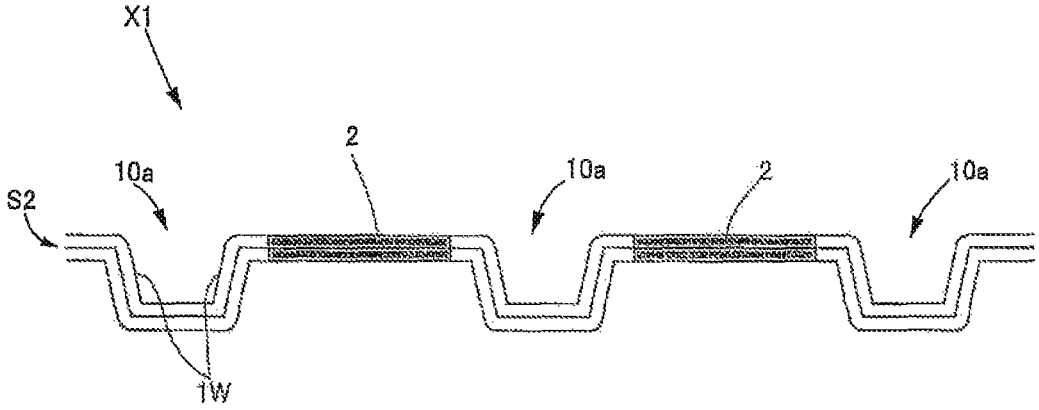
FIG. 5 is an enlarged view of a cross-section taken along the line A-A of FIG. 4.

Accordingly, as understood from FIGS. 4 and 5, the strength of side wall 1W of each of the concave embossed portions 10*a*, 10*a*, which have been formed on the continuous crepe paper S2 by the press-contact with the embossing convex portions 1, 1, is lowered little. Accordingly, the problems in the manufacturing are solved, which were explained in the section of Background Art. Then, since the present invention employs the specific composition of the chemicals and the specific chemicals applying manner, the chemicals are impregnated into the crepe paper in the plane direction. Thus, the chemicals are impregnated into the entire surface, so that the softness, the moisture-retaining property, and the lubricating property are excellent in the state of the products.

In this case, as described before, the sizing agent is used. This agent makes it possible to control the impregnation of the chemicals into the crepe paper in the plane direction so as to prevent the crushing of the embossing, which would caused by the impregnated chemicals.

Here, it is desirable to employ the convex embossing roll 60 in which the area of one embossing convex portion 1 in the plan view is 0.64 to 4.0 mm$^2$ and the embossing density of the embossing convex portions 1 is 2.0 to 32.0 units/cm$^2$. The embossing convex portion 1 of smaller than 0.64

$mm^2$ makes it difficult to scrape sufficiently the excrement with the embossed toilet paper X1, leading to lowered improvement in the wiping property. On the other hand, the embossing convex portion 1 of larger than 4.0 $mm^2$ makes it difficult to exhibit the bulkiness of the toilet paper. The embossing density of smaller than 2.0 units/$cm^2$ makes it difficult to exhibit the effects of the wiping property and the bulkiness brought by the embossing of the toilet paper X1. On the contrary, the embossing density of more than 32 units/$cm^2$ makes it difficult to obtain the sufficient chemicals application portions and may cause insufficient amount of impregnated chemicals. In the present invention, the embossing is performed non-chemicals-application portions, thus, in other words, in the manufacturing, the rest is applied with the chemicals by the above mentioned embossing manner.

However, there is no need to completely match the chemicals-application portions 2, 2 and the emboss portion 10 during manufacturing. When there is preferably a gap between the chemicals-application portion 2 and the emboss portion 10, it is possible to appropriately suppress the paper breakage in embossing. Accordingly, it is desirable that there is the gap to such a degree that the impregnation of the chemicals with time is not prevented. Specifically, the preferable gap is 0.15 to 2.0 mm or smaller. The gap used herein is equal to a distance between the emboss portion 10, which is pressed by the embossing convex portion 1, and the chemicals-application portion 2, which is the closest to the emboss portion.

Here, the embossing convex portion 1 indicates the convex portion 1, which is provided on the peripheral surface of the convex embossing roll so as to form the emboss pattern. The area of the embossing convex portion 1 in the plan view indicates the area of the embossing convex portion in the plan view when the embossing roll is developed as a plane. On the other hand, the embossing density indicates the number of the embossing convex portions a per unit area of the peripheral surface of the embossing roll when the embossing roll is developed.

Further, it is preferable that the height of the embossing convex portion 1 is 1.1 to 1.5 mm. The height of smaller than 1.1 mm makes it difficult to exhibit the bulkiness. The height of larger than 1.5 mm makes it difficult to prevent the problem in the tearing in manufacturing even in the present invention. Furthermore, the height of the embossing convex portion is substantially equal to the depth of the concave embossed portion 10*a* in the paper plane in the embossing manner. Further, the height is the distance from a virtual peripheral surface of the embossing roll at the lowest position thereof to the apex surface of the embossing convex portion.

Here, in the present invention, it is preferable that the embossing convex portions 1 are regularly arranged in the length and width directions in the paper plane as illustrated in the drawings. By doing so, the embossing convex portions 1 are arranged uniformly, and hence the advantageous effects brought by the embossing is exhibited in the entire paper plane.

Figure 6:
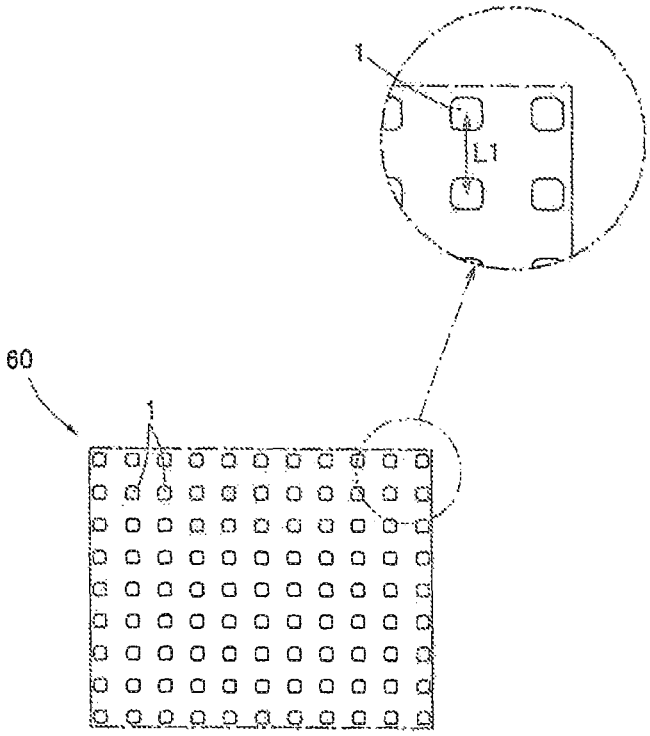
FIG. 6 is a plan view in which a surface of a convex embossing roll according to the present invention is depicted as a plane.

Here, the shape of the embossing convex portion 1 is not particularly limited, and a circular shape, an oval shape, a tetragon shape, and a chamfered tetragon are desirable. The shape of the embossing convex portion 1 herein is the shape thereof in the embossing roll developed as a plane. Specifically, the chamfered tetragon is desirable, and above all, the chamfered regular tetragon illustrated in FIG. 6 is particularly desirable. In the chamfered regular tetragon, the embossing is hardly crushed, and the bulkiness is easily exhibited. Additionally, due to the embossing convex portion having such shape, the toilet paper offers an excellent scraping property of the excrement in the wiping, as well as an excellent lubricating hand feel. Further, since the corners are chamfered, the aqueous chemicals are likely to impregnate uniformly.

Furthermore, it is desirable that the pitch (interval) L1 between the adjacent embossing convex portions 1 is 3.0 to 5.0 mm. With the embossing portion configured as stated above, the pitch in such a numerical range offers better smoothness and better design property. The pitch of smaller than 3.0 mm eliminates the thickness hand feel and the bulkiness. On the other hand, the pitch of more than 5.0 mm causes high possibility of tearing between the embossing convex portions 1 in the embossing, resulting in lowered productivity. The pitch used herein indicates a gap between the apexes or between the centers of gravity of apex surfaces of the adjacent embossing convex portions 1.

Meanwhile, in the method for manufacturing the toilet paper according to the present invention, the embossing can be performed by bringing the embossing convex portions into press-contact with only one side surface of the continuous crepe paper. By doing so, the toilet paper X1 with a so-called single embossing may be manufactured in which one side surface of the paper plane is provided with only the concave emboss portions, while the other side surface of the paper plane is provided with only the convex emboss portions corresponding to the concave emboss portions. Alternatively, the toilet paper X1 with a so-called double embossing may be manufactured in which the paper surfaces provided with the convex emboss portions face each other (an example for manufacturing the toilet paper with the double embossing is illustrated in FIG. 7).

In the single embossing, particularly for attaining multi-ply forming, the crepe papers can be multi-plied and integrated without using glue, leading to an advantage in water disintegration property. Additionally, in the single embossing, perforation, tearing and paper dusts, which would be caused by the embossing, can be prevented. Further, in the single embossing, since there is no need to individually emboss the respective crepe papers, the manufacturing can be carried out easily.

Furthermore, with the toilet paper X1 of the single embossing, when the wiping is performed by using the surface provided with the convex emboss portions (the surface opposite to the surface with which the embossing convex portions 1 are brought into press-contact), the convex emboss portions are to contact to the skin. Although the convex emboss portions are the non-chemicals-application portions in the manufacturing, in the present invention where the above mentioned embossing manner, composition of the chemicals, impregnating manner of the chemicals, and the like are employed, the chemicals can be impregnated gradually also into the convex emboss portions, which offers sufficiently the advantageous effects such as the smoothness brought by the chemicals applying.

Meanwhile, in the toilet paper X1 of the double embossing, a gap is formed between the convex embossed surfaces, leading to the advantage in bulkiness. Further, since the convex embossed portions as the non-chemicals application portions become an inner surface of the multi-ply forming structure in manufacturing, it is possible to sufficiently obtain an effect such as smoothness by the chemicals applying regardless of whether or not the chemicals are impregnated into the portion.

[Water Disintegration Property]

Here, the toilet paper X1 according to the present invention has the water disintegration property. Specifically, the value of the water disintegration property is preferably 5 to 20 seconds. The water disintegration property used herein is expressed by seconds in a disintegratability test (according to the toilet paper disintegratability test of JIS P 4501). The water disintegration property of smaller than 5 seconds causes possibility that disintegrated crepe paper adheres to the skin, when the toilet paper is used for wiping in the shower toilet or the like. Furthermore, the numerical values of the water disintegration property of 5 to 20 seconds are very high water disintegration properties. In the present invention, the toilet paper can sufficiently perform the wiping in the shower toilet or the like in spite of the above-mentioned high water disintegration property due to the characteristic relation between the chemicals applying and the embossing.

[Test 1]

In order to review the improvements according to the present invention for solving the problems in the manufacturing, the surface lubrication property and tearing in the manufacturing and those in the using are evaluated in examples and comparative examples, and the results are illustrated below. Manufacturing conditions used here are the same except for embossing manner and chemicals applying manner.

Table 1 shows the embossing manners and the chemicals applying manners in the examples and those in the comparative examples as well as their evaluation results.

Symbols illustrated in the tables mean the following evaluation results.

[Surface Property]

"○" indicates a state where the smoothness is excellent, "Δ" indicates a state where the smoothness is felt, and "x" indicates a state where the smoothness is not felt.

[Tearing in Manufacturing]

"○" indicates a state where the tearing does not occur in the manufacturing, "Δ" indicates a state where the tearing occurs occasionally in the manufacturing, and "X" indicates a state where the tearing frequently occurs in the manufacturing.

[Tearing in Using]

"○" indicates a state where the tearing does not occur in the using, and "Δ" indicates a state where the tearing occurs in the using but no difficulty in the using. "X" indicates a state where the tearing easily occurs in the using.

TABLE 1

| | | | | Surface property (smoothness) | | | |
|---|---|---|---|---|---|---|---|
| | Chemicals-applying | Chemicals-applying manner | Embossing shape | Having concave portions | Having convex portions | Tearing in producing | Tearing in using |
| Example 1 | Yes | Applied in scattered state | Chamfered tetragon | ○ | ○ | ○ | Δ |
| Example 2 | Yes | Applied in scattered state | Chamfered tetragon | ○ | ○ | ○ | ○ |
| Comparative example 1 | Yes | Applied entirely | tetragon | ○ | ○ | X | X |
| Comparative example 2 | Yes | Applied entirely | Chamfered tetragon | ○ | ○ | X | X |
| Comparative example 3 | No | — | tetragon | Δ | Δ | ○ | ○ |
| Comparative example 4 | No | — | Chamfered tetragon | Δ | X | ○ | Δ |

As shown in Table 1, the examples in accordance with the present invention generate desirable results such as the excellent surface property while there is no problem in the producing and the using. However, the comparative examples generate undesirable results due to some low evaluations.

[Test 2]

In order to review the main usability such as the smoothness hand feel of the toilet paper obtained by the method for manufacturing according to the present invention, the properties, the usability, and the like are measured and evaluated, with regard to examples and reference examples (embossed and not applied with chemicals) and the results are illustrated below.

Table 1 and Table 2 show manufacturing conditions, embossing manners, chemicals applying manners, and the like in the respective examples and respective reference examples. Table 2 and Table 3 show also the results such as the evaluation. Table 2 shows a case of one ply and single embossing and Table 3 indicates two plies and double embossing.

TABLE 2

| | | | Ex. 1 | Ex. 2 | Ex. 3 | Ex. 4 | Ex. 5 | Ex. 6 | Ex. 7 | Ref. Ex. 1 |
|---|---|---|---|---|---|---|---|---|---|---|
| Raw material | LBKP | % | 60 | 60 | 60 | 60 | 60 | 60 | 60 | 60 |
| | NBKP | % | 40 | 40 | 40 | 40 | 40 | 40 | 40 | 40 |
| Sizing agent AKD | | kg/t | 2.0 | 2.0 | 2.0 | 2.0 | 2.0 | 2.0 | 2.0 | 2.0 |
| Basis weight (1 ply) | | $g/m^2$ | 21.6 | 21.7 | 21.5 | 22.0 | 22.0 | 21.1 | 20.9 | 21.3 |
| Number of plies | | — | 1 | 1 | 1 | 1 | 1 | 1 | 1 | 1 |
| Thickness (after plying) | | μm | 129 | 124 | 126 | 124 | 125 | 120 | 122 | 132 |
| Amount of applied chemicals (front surface) | | $g/m^2$ | 1.2 | 2.2 | 3.1 | 4.5 | 6.3 | 3.0 | 2.5 | 0.0 |
| Viscosity of applied chemicals | | mPas | 100 | 100 | 100 | 100 | 100 | 100 | 100 | — |
| Shape of chemicals-application portion | | mm | Argyle | Argyle | Rect. | Argyle | Rect. | Rect. | Argyle | — |
| Length of chemicals-application portion (MD) | | mm | 1.6 | 2.0 | 1.5 | 2.5 | 1.8 | 5.0 | 1.0 | — |
| Width of chemicals-application portion (CD) | | mm | 1.6 | 1.8 | 1.5 | 3.0 | 1.8 | 5.0 | 1.0 | — |
| Area of chemicals-application portion | | $mm^2$ | 1.3 | 1.8 | 1.1 | 3.8 | 1.6 | 12.5 | 0.5 | — |
| Pitch of chemicals-application portion (MD) | | mm | 5.0 | 5.0 | 6.0 | 5.0 | 4.2 | 12.0 | 1.7 | — |
| Pitch of chemicals-application portion (CD) | | mm | 5.0 | 5.0 | 8.0 | 5.0 | 4.2 | 12.0 | 1.7 | — |
| Ratio of area of chemicals-application portions (*A) | | % | 5.1 | 7.2 | 2.3 | 15.0 | 9.2 | 8.7 | 17.3 | — |
| Total area of chemicals-application portions (*B) | | % | 45 | 32 | 54 | 67 | 56 | 60 | 45 | 0 |
| Shape of embossing convex portion (*C) | | mm | Rect. | Rect. | Argyle | Rect. | Argyle | Argyle | Rect. | Rect. |
| Length of embossing convex portion (MD) | | mm | 1.5 | 1.5 | 2.5 | 1.5 | 1.3 | 2.0 | 1.0 | 1.5 |
| Width of embossing convex portion (CD) | | mm | 1.5 | 1.5 | 3.0 | 1.5 | 1.3 | 1.8 | 1.0 | 1.5 |
| Area of embossing convex portion | | $mm^2$ | 1.1 | 1.1 | 3.8 | 1.1 | 0.8 | 1.8 | 0.5 | 1.1 |
| Pitch of embossing convex portion (MD) | | mm | 5.0 | 5.0 | 6.0 | 5.0 | 4.2 | 12.0 | 1.7 | 5.0 |
| Pitch of embossing convex portion (CD) | | mm | 5.0 | 5.0 | 8.0 | 5.0 | 4.2 | 12.0 | 1.7 | 5.0 |
| Ratio of area of embossing convex portions | | % | 4.5 | 4.5 | 7.8 | 4.5 | 4.8 | 1.3 | 17.3 | 4.5 |
| Density of embossing convex portions | | $unit/cm^2$ | 4.0 | 4.0 | 2.1 | 4.0 | 5.7 | 0.7 | 34.6 | 4.0 |
| Height of embossing convex portion | | mm | 1.1 | 1.5 | 1.2 | 1.5 | 1.2 | 1.2 | 1.0 | 1.5 |
| Properties of paper | Dry tensile strength (MD) | cN/25 mm | 242 | 260 | 244 | 287 | 268 | 242 | 244 | 245 |
| | Dry tensile strength (CD) | cN/25 mm | 80 | 91 | 90 | 106 | 97 | 80 | 89 | 85 |
| | Moisture content (23° C., 50% RH) | % | 9.2 | 9.8 | 11.3 | 10.5 | 12.2 | 11.0 | 10.3 | 7.3 |
| | Water absorption speed (front surface*1) | second | 2.3 | 2.5 | 2.5 | 2.8 | 3.0 | 2.8 | 3.0 | 1.8 |
| | Water absorption speed (rear surface*2) | second | 1.9 | 2.0 | 2.2 | 2.3 | 2.5 | 2.2 | 2.5 | 1.2 |
| | Water disintegration property (JIS P 3104) | second | 12.3 | 13.5 | 13.3 | 13.0 | 14.5 | 15.3 | 14.5 | 12.0 |
| Organoleptic evaluation on a five point scale by 17 persons | Lubrication property (front surface *1) | (low) 1-5 (high) | 4 | 4 | 5 | 5 | 4 | 3 | 3 | 3 |
| | Wetness hand feel (front surface *1) | (low) 1-5 (high) | 4 | 4 | 5 | 5 | 5 | 3 | 3 | 3 |
| | Wiping hand feel (rear surface*2) | (low) 1-5 (high) | 4 | 4 | 5 | 5 | 5 | 3 | 3 | 3 |
| | Water absorbability (front surface *1) | (low) 1-5 (high) | 3 | 3 | 3 | 3 | 3 | 3 | 3 | 3 |
| | Toughness (front surface *1) | (low) 1-5 (high) | 3 | 3 | 3 | 3 | 3 | 3 | 3 | 3 |
| | Lubrication property (rear surface *2) | (low) 1-5 (high) | 3 | 4 | 4 | 4 | 4 | 3 | 3 | 3 |
| | Wetness hand feel (rear surface *2) | (low) 1-5 (high) | 4 | 4 | 5 | 5 | 5 | 3 | 3 | 3 |
| | Wiping hand feel (rear surface *2) | (low) 1-5 (high) | 4 | 4 | 5 | 5 | 5 | 3 | 3 | 3 |
| | Water absorbability (rear surface *2) | (low) (1-5 (high) | 3 | 3 | 3 | 3 | 3 | 3 | 3 | 3 |
| | Solidity (rear surface *2) | (low) 1-5 (high) | 3 | 3 | 3 | 3 | 3 | 3 | 3 | 3 |

TABLE 3

| | | | Ex. 1 | Ex. 2 | Ex. 3 | Ex. 4 | Ex. 5 | Ex. 6 | Ex. 7 | Ref. Ex. 2 |
|---|---|---|---|---|---|---|---|---|---|---|
| Raw material | LBKP | % | 60 | 60 | 60 | 60 | 60 | 60 | 60 | 60 |
| | NBKP | % | 40 | 40 | 40 | 40 | 40 | 40 | 40 | 40 |

TABLE 3-continued

| | | | Ex. 1 | Ex. 2 | Ex. 3 | Ex. 4 | Ex. 5 | Ex. 6 | Ex. 7 | Ref. Ex. 2 |
|---|---|---|---|---|---|---|---|---|---|---|
| Sizing agent AKD | | kg/t | 2.0 | 2.0 | 2.0 | 2.0 | 2.0 | 2.0 | 2.0 | 2.0 |
| Basis weight (1 ply) | | $g/m^2$ | 16.2 | 16.5 | 16.8 | 16.8 | 16.9 | 16.6 | 16.6 | 16.2 |
| Number of plies | | — | 2 | 2 | 2 | 2 | 2 | 2 | 2 | 2 |
| Thickness (after plying) | | μm | 122 | 125 | 120 | 123 | 124 | 128 | 129 | 130 |
| Amount of applied chemicals (front surface 1) | | $g/m^2$ | 0.8 | 1.5 | 2.4 | 2.8 | 3.1 | 1.5 | 2.5 | 0.0 |
| Amount of applied chemicals (front surface 2) | | $g/m^2$ | 0.8 | 1.5 | 2.4 | 2.8 | 3.1 | 1.5 | 2.5 | 0.0 |
| Viscosity of applied chemicals | | mPas | 100 | 100 | 100 | 100 | 100 | 100 | 100 | |
| Shape of chemicals-application portion | | mm | Argyle | Argyle | Rect. | Argyle | Rect. | Rect. | Argyle | |
| Length of chemicals-application portion (MD) | | mm | 1.6 | 2.0 | 1.5 | 2.5 | 1.8 | 5.0 | 1.0 | |
| Width of chemicals-application portion (CD) | | mm | 1.6 | 1.8 | 1.5 | 3.0 | 1.8 | 5.0 | 1.0 | |
| Area of chemicals-application portion | | $mm^2$ | 1.3 | 1.8 | 1.1 | 3.8 | 1.6 | 12.5 | 0.5 | |
| Pitch of chemicals-application portion (MD) | | mm | 5.0 | 5.0 | 6.0 | 5.0 | 4.2 | 12.0 | 1.7 | |
| Pitch of chemicals-application portion (CD) | | mm | 5.0 | 5.0 | 8.0 | 5.0 | 4.2 | 12.0 | 1.7 | |
| Ratio of area of chemicals-application portions (*A) | | % | 5.1 | 7.2 | 2.3 | 15.0 | 9.2 | 8.7 | 17.3 | |
| Total area of chemicals-application portions (*B) | | % | 45 | 32 | 54 | 67 | 56 | 60 | 54 | 0 |
| Shape of embossing convex portion | | mm | Rect. | Rect. | Argyle | Rect. | Argyle | Argyle | Rect. | Rect. |
| Length of embossing convex portion (MD) | | mm | 1.5 | 1.5 | 2.5 | 1.5 | 1.3 | 2.0 | 1.0 | 1.5 |
| Width of embossing convex portion (CD) | | mm | 1.5 | 1.5 | 3.0 | 1.5 | 1.3 | 1.8 | 1.0 | 1.5 |
| Area of embossing convex portion | | $mm^2$ | 1.1 | 1.1 | 3.8 | 1.1 | 0.8 | 1.8 | 0.5 | 1.1 |
| Pitch of embossing convex portion (MD) | | mm | 5.0 | 5.0 | 6.0 | 5.0 | 4.2 | 12.0 | 1.7 | 5.0 |
| Pitch of embossing convex portion (CD) | | mm | 5.0 | 5.0 | 8.0 | 5.0 | 4.2 | 12.0 | 1.7 | 5.0 |
| Ratio of area of embossing convex portions | | % | 4.5 | 4.5 | 7.8 | 4.5 | 4.8 | 1.3 | 17.3 | 4.5 |
| Density of embossing convex portions | | $unit/cm^2$ | 4.0 | 4.0 | 2.1 | 4.0 | 5.7 | 0.7 | 34.6 | 4.0 |
| Height of embossing convex portion | | mm | 1.1 | 1.5 | 1.2 | 1.5 | 1.2 | 1.2 | 1.0 | 1.5 |
| Properties of paper | Dry tensile strength (MD) | cN/25 mm | 252 | 260 | 244 | 287 | 268 | 244 | 258 | 270 |
| | Dry tensile strength (CD) | cN/25 mm | 99 | 100 | 105 | 106 | 109 | 104 | 104 | 112 |
| | Moisture content (23° C., 50% RH) | % | 9.4 | 9.8 | 11.0 | 12.0 | 13.1 | 8.2 | 10.5 | 7.3 |
| | Water absorption speed (front surface*1) | second | 4.3 | 4.6 | 5.4 | 6.0 | 5.6 | 5.0 | 5.5 | 4.3 |
| | Water absorption speed (rear surface*2) | second | 3.6 | 4.0 | 4.6 | 5.2 | 6.0 | 4.2 | 4.8 | 3.6 |
| | Water disintegration property (JIS P 3104) | second | 12.3 | 13.5 | 13.3 | 13.0 | 14.5 | 15.3 | 14.2 | 12.0 |
| Organoleptic evaluation on a five point scale by 17 persons | Lubrication property (front surface *1) | (low) 1-5 (high) | 4 | 4 | 5 | 5 | 4 | 3 | 3 | 3 |
| | Wetness hand feel (front surface *1) | (low) 1-5 (high) | 4 | 4 | 5 | 5 | 5 | 3 | 3 | 3 |
| | Wiping hand feel (rear surface*2) | (low) 1-5 (high) | 4 | 4 | 5 | 5 | 5 | 3 | 3 | 3 |
| | Water absorbability (front surface *1) | (low) 1-5 (high) | 3 | 3 | 3 | 3 | 3 | 3 | 3 | 3 |
| | Toughness (front surface *1) | (low) 1-5 (high) | 3 | 3 | 3 | 3 | 3 | 3 | 3 | 3 |

Meaning of each item in tables and references of the organoleptic evaluation are illustrated as below.

*A; "Ratio of area of chemicals-application portions" indicates the "total area of the chemicals-application portions transferred from the printing plate to the paper with respect to the chemicals-application area of one side surface of the paper plane".

*B; "Total area of chemicals-application portions" indicates the "area of the portions to be applied with the chemicals with respect to the entire area of the one side surface of the paper plane".

*C; "Rect." of "Shape of embossing convex portion" indicates the "rectangular, which is surrounded by two lines in each of the MD direction and CD direction", and "Argyle" indicates the "argyle whose diagonal lines connecting respective opposite angles are extended in the MD direction and CD direction".

*1; "front surface" indicates the surface, which is applied with the chemicals and contacts the embossing convex portions.

*2; "rear surface" indicates the surface, which is opposite to the "front surface".

<Organoleptic Evaluation>

[Smoothness]

"5" indicates that it has very good hand feel and it is smoother than the conventional products, "4" indicates that it has good hand feel and it is smoother than the conventional products, "3" indicates that it is the same in smoothness as the conventional products, "2" indicates that it is less smooth than the conventional products, and "1" indicates that it is much less smooth than the conventional products.

[Wetness Hand Feel]

"5" indicates that it is remarkably moister than the conventional products, "4" indicates that it is moister than the conventional products, "3" indicates that it is the same in moistness as the conventional products, "2" indicates that it is less moist than the conventional products, and "1" indicates that it has flakiness hand feel and it is much less moist than the conventional products.

[Wiping Hand Feel]

"5" indicates that it is much comfortable than the conventional products in the wiping, "4" indicates that it is more comfortable than the conventional products in the wiping, "3" indicates that it is the same in comfort as the conventional products, "2" indicates that it is less comfortable than the conventional products, and "1" indicates that it is much less comfortable than the conventional products.

[Water Absorbability]

"5" indicates that the water absorbability is much faster than those of the conventional products, "4" indicates that the water absorbability is faster than those of the conventional products, "3" indicates that the water absorbability is the same as those of the conventional products, "2" indicates that the water absorbability is slower than those of the conventional products, and "1" indicates that the water absorbability is much slower than those of the conventional products.

[Toughness]

"5" indicates that it is tougher than the conventional products and not torn in the wiping, "4" indicates that it is less likely to be torn than the conventional products in the wiping, "3" indicates that it is the same in toughness as the conventional products, "2" indicates that it is less tough than the conventional products, and "1" indicates that it is much less tough than the conventional products.

According to Table 2 and Table 3, in the examples of the present invention, it is found that availability is remarkably improved compared to the reference examples for those embossed and not applied with chemicals. That is, it is found that the availability can be sufficiently improved even when the toilet paper is manufactured without applying the chemicals to the emboss portion.

In view of the improvements according to the present invention for solving the problems in the manufacturing shown in Test 1, by the present invention, it is possible to attain the toilet paper, which solves the problems in the manufacturing such as the paper breakage, as well as which has the excellent availability.

BRIEF DESCRIPTION OF SYMBOLS

X1 - - - toilet paper
1 - - - embossing convex portion
10 - - - emboss position (emboss portion)
10*a* - - - concave embossed portion
2 - - - chemicals-application portion
S1, S2 - - - continuous crepe paper
5 - - - printer
50 - - - printing plate cylinder
6 - - - embossing device
60 - - - convex embossing roll
61 - - - impression cylinder, rubber backing roll
7 - - - application position detecting device
8 - - - tension roll

The invention claimed is:

1. A method for manufacturing toilet paper impregnated with aqueous lotion chemicals, comprising:

a chemicals applying step of printing and applying aqueous lotion chemicals onto band-like continuous crepe paper by using a printing plate cylinder and an impression cylinder, wherein a pattern with non-chemicals-application portions and chemicals-application portions is formed on the band-like continuous crepe paper; and an embossing step of passing the continuous crepe paper, which has been applied with the chemicals in the chemicals applying step, between an embossing roll with embossing convex portions and a backing roll making a pair with the embossing roll, wherein the embossing convex portions are brought into press-contact only to the entire non-chemicals-application portions of the continuous crepe paper so that the continuous crepe paper is embossed.

2. The method for manufacturing the toilet paper according to claim 1, wherein the impression cylinder doubles as the backing roll so that the chemicals applying and the embossing can be performed by the only one impression cylinder.

3. The method for manufacturing the toilet paper according to claim 1, wherein after the chemicals applying step, chemicals-application positions of the continuous crepe paper are checked by a chemicals-application position detecting device and emboss positions are adjusted in response to the checking result.

4. The method for manufacturing the toilet paper according to claim 3, wherein in the embossing roll, the embossing convex portions are arranged with a gap therebetween, the density of the embossing convex portions is 2.0 to 32.0 units/$cm^2$, and the area of one embossing convex portion in a plan view is 0.64 to 4.0 $mm^2$.

5. The method for manufacturing the toilet paper according to claim 4, wherein the embossing convex portion has a shape of chamfered tetragon in a plan view.

6. The method for manufacturing the toilet paper according to claim 4, wherein the height of the embossing convex portion is 1.1 to 1.5 mm.

7. The method for manufacturing the toilet paper according to claim 4, wherein a convex embossing roll is used of which the embossing convex portions are regularly arranged in horizontal and vertical directions.

8. The method for manufacturing the toilet paper according to claim 4, wherein the embossing convex portions are brought into press-contact to only one side surface of the continuous crepe paper so as to provide only concave embossed portions on the one side surface of the toilet paper and only convex embossed portions corresponding to the concave embossed portions on the other side surface of the toilet paper.

9. The method for manufacturing the toilet paper according to claim 1, wherein the chemicals-application portions are arranged in a regular pattern of a net shape or a lattice shape in a plan view.

10. The method for manufacturing the toilet paper according to claim 1, wherein the total area of the chemicals-application portions is set to 30 to 70% of a total area of one side surface of a paper plane.

* * * * *